US012383027B2

(12) United States Patent
Chang

(10) Patent No.: US 12,383,027 B2
(45) Date of Patent: Aug. 12, 2025

(54) STRESS-REDUCING INSOLE

(71) Applicant: Tsang-Chuan Chang, Taichung (TW)

(72) Inventor: Tsang-Chuan Chang, Taichung (TW)

( * ) Notice: Subject to any disclaimer, the term of this patent is extended or adjusted under 35 U.S.C. 154(b) by 54 days.

(21) Appl. No.: 18/495,974

(22) Filed: Oct. 27, 2023

(65) Prior Publication Data

US 2025/0009071 A1 Jan. 9, 2025

(30) Foreign Application Priority Data

Jul. 4, 2023 (TW) ..... 112124963

(51) Int. Cl.
*A43B 13/20* (2006.01)
*A43B 13/12* (2006.01)

(52) U.S. Cl.
CPC ..... *A43B 13/203* (2013.01); *A43B 13/125* (2013.01)

(58) Field of Classification Search
None
See application file for complete search history.

(56) References Cited

U.S. PATENT DOCUMENTS 1,304,915 A * 5/1919 Spinney ..... A43B 17/03 36/153
3,748,756 A * 7/1973 White ..... A43D 999/00 36/97
4,217,705 A * 8/1980 Donzis ..... A43B 13/206 36/153
4,747,219 A * 5/1988 Ammendolea ..... A43B 13/182 36/11.5
4,782,603 A * 11/1988 Brown ..... A43B 13/181 36/28
4,887,367 A * 12/1989 Mackness ..... A43B 1/0018 36/35 B
5,179,792 A * 1/1993 Brantingham ..... A43B 13/203 36/71
5,813,142 A * 9/1998 Demon ..... A43B 3/44 600/592
6,192,606 B1 * 2/2001 Pavone ..... A43B 13/20 36/35 B
6,519,873 B1 * 2/2003 Buttigieg ..... A43B 3/108 36/29
11,096,446 B2 * 8/2021 Brandt ..... B29C 66/438
2012/0073161 A1 * 3/2012 Doyle ..... A43B 13/203 36/29
2014/0165427 A1 * 6/2014 Molyneux ..... A43B 3/34 36/102

* cited by examiner

*Primary Examiner* — Jila M Mohandesi
(74) *Attorney, Agent, or Firm* — Best & Flanagan LLP

(57) ABSTRACT

A stress-reducing insole includes a cushion unit, a frame and a superficial layer. The cushion unit includes air bags connected to one another. Each of the air bags includes a valve via which air is pumped into or released from the corresponding one of the air bags. The frame extends around the cushion unit and includes bores for receiving the valves. The superficial layer covers one of two opposite faces of the cushion unit.

5 Claims, 10 Drawing Sheets

STRESS-REDUCING INSOLE

BACKGROUND OF INVENTION

1. Field of Invention

The present invention relates to an insole for footwear and, more particularly, to a stress-reducing insole.

2. Related Prior Art

Painful areas of a sole of a foot are inevitably pressed when the foot is put in footwear. Thus, the pain in the painful areas of the sole is increased. Moreover, the recovery of the painful areas is compromised.

As disclosed in U.S. Pat. Nos. 5,768,803, 4,793,078 and 5,438,768, inserts such as air bags and elastic blocks are inserted in insoles to provide some gaps between the insole and a user's sole. The gaps are intended to reduce pain in painful areas of the sole.

U.S. Pat. No. 5,768,803 even discloses providing an insole with air bags. Some of the air bags corresponding to painful areas of a sole are deflated while the remaining ones of the air bags are inflated. The deflated air bags are intended to reduce stress in the painful areas of the sole.

Disadvantageously, the inserts can easily be lost when they are detached from the insoles. Moreover, it has not been disclosed about how to inflate or deflate the air bags.

The present invention is therefore intended to obviate or at least alleviate the problems encountered in the prior art.

SUMMARY OF INVENTION

It is the primary objective of the present invention to provide effective and convenient stress-reducing insole.

To achieve the foregoing objective, the stress-reducing insole includes a cushion unit, a frame and a superficial layer. The cushion unit includes air bags connected to one another. Each of the air bags includes a valve via which air is pumped into or released from the corresponding one of the air bags. The frame extends around the cushion unit and includes bores for receiving the valves. The superficial layer covers one of two opposite faces of the cushion unit.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF EMBODIMENTS

Figure 1:
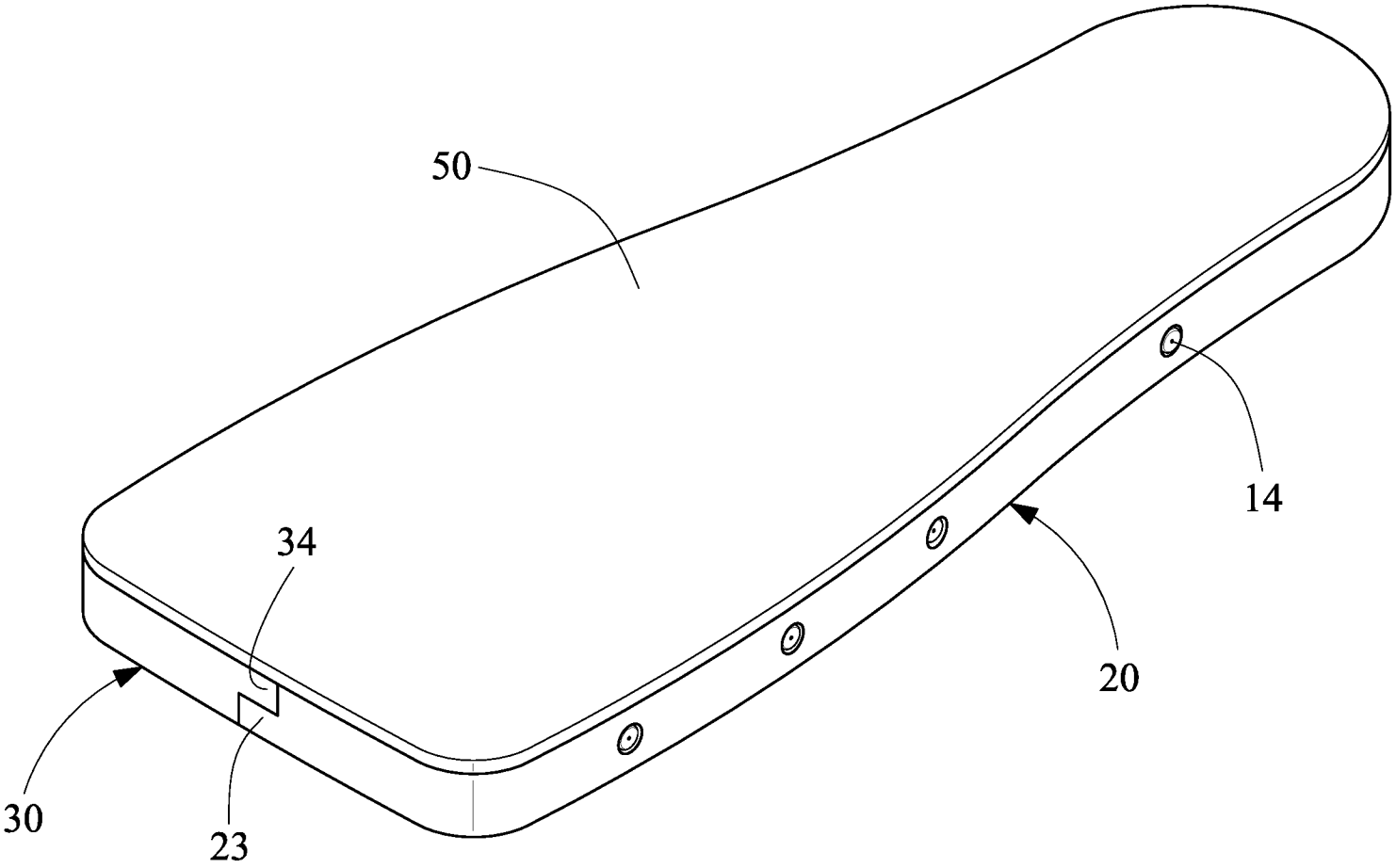
FIG. 1 is a perspective view of a stress-reducing insole according to the preferred embodiment of the present invention.
Figure 2:
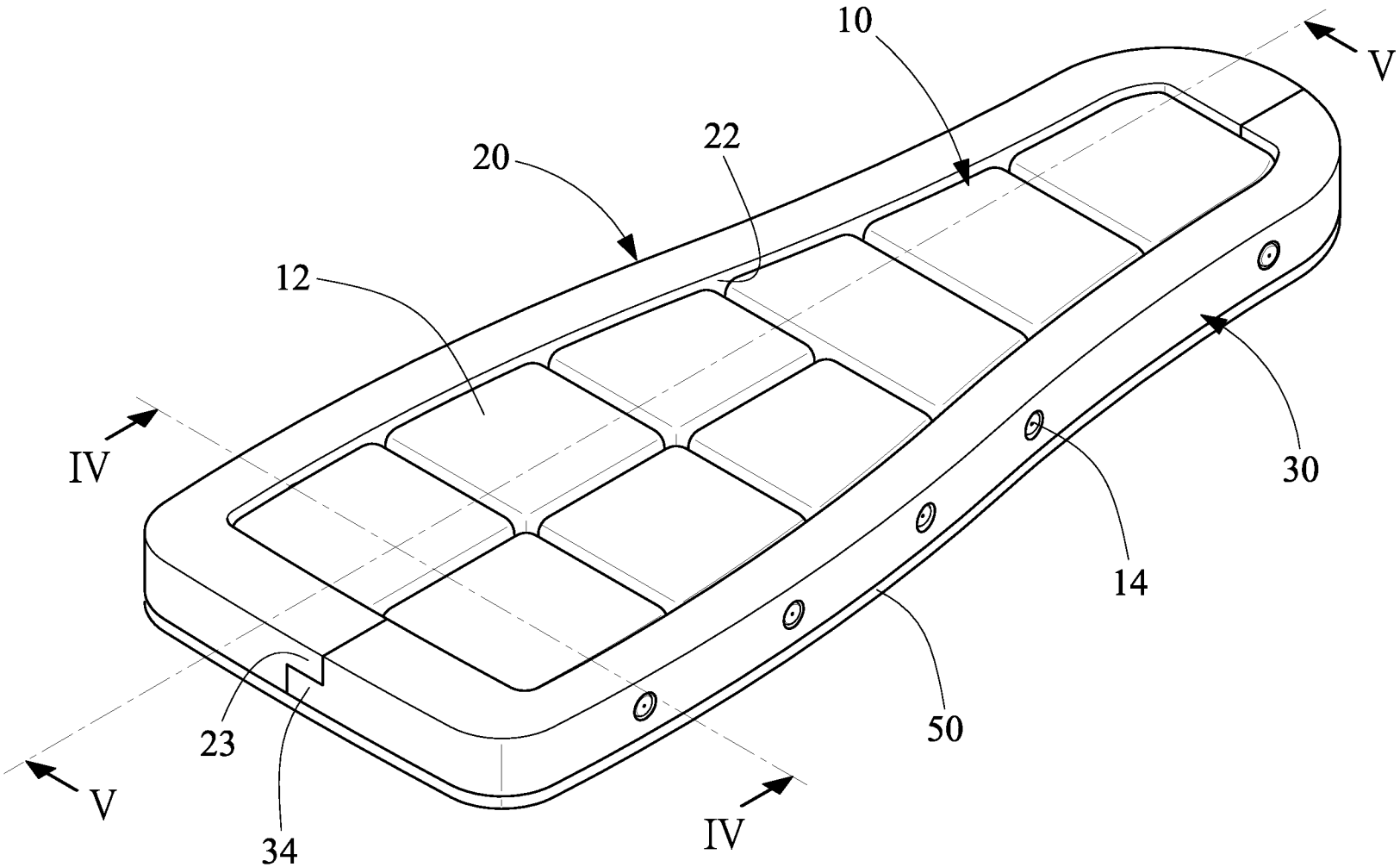
FIG. 2 is another perspective view of the stress-reducing insole shown in FIG. 1.
Figure 3:
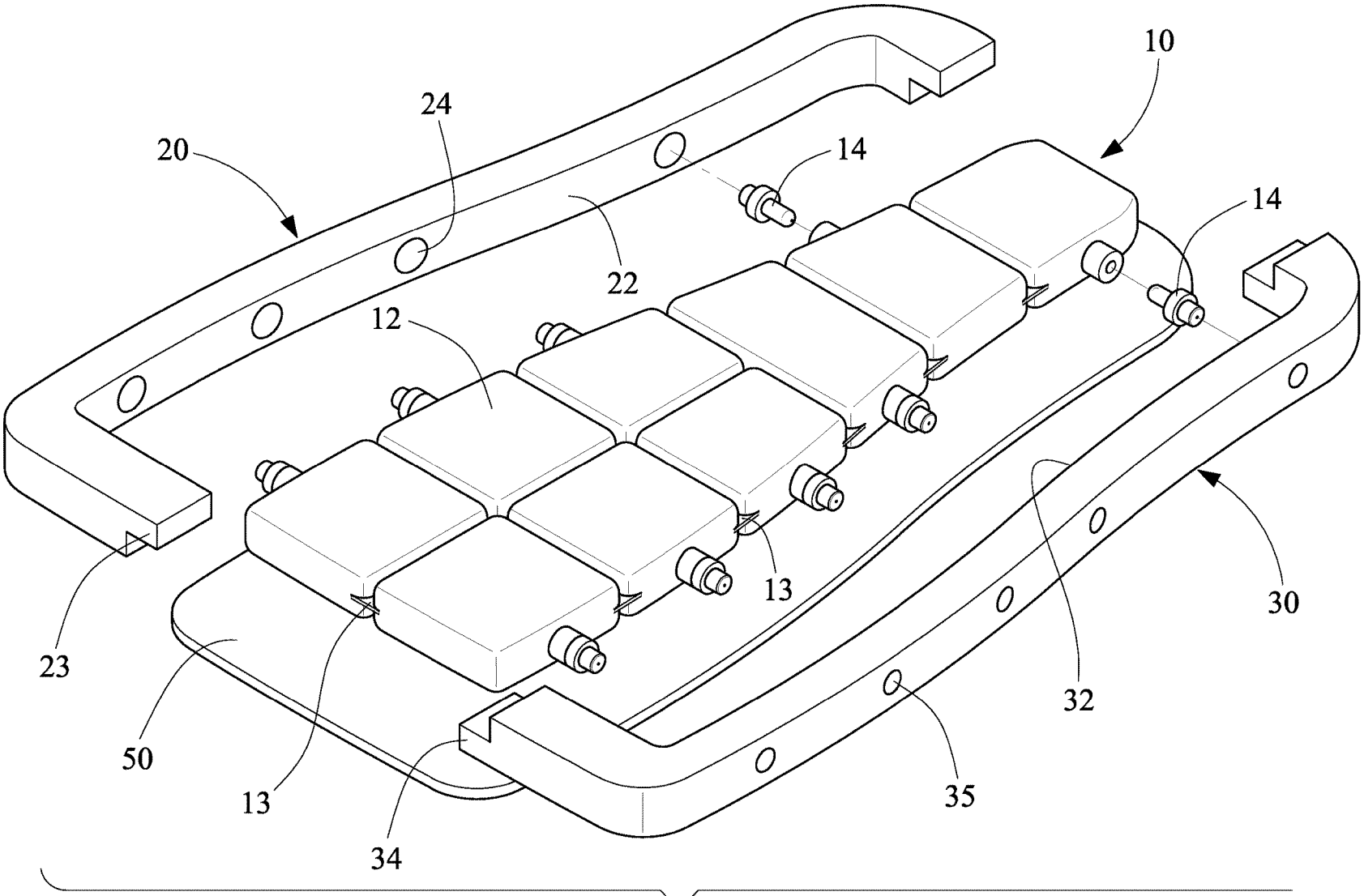
FIG. 3 is an exploded view of the stress-reducing insole depicted in FIG. 1.
Figure 4:
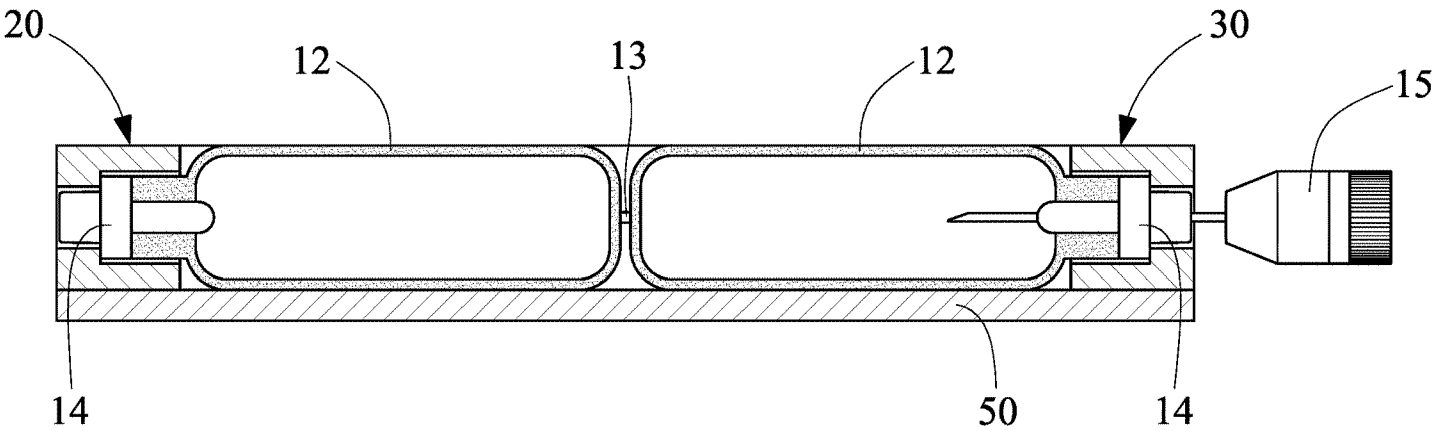
FIG. 4 is a cross-sectional view of the stress-reducing insole taken along a line IV-IV shown in FIG. 2.
Figure 5:
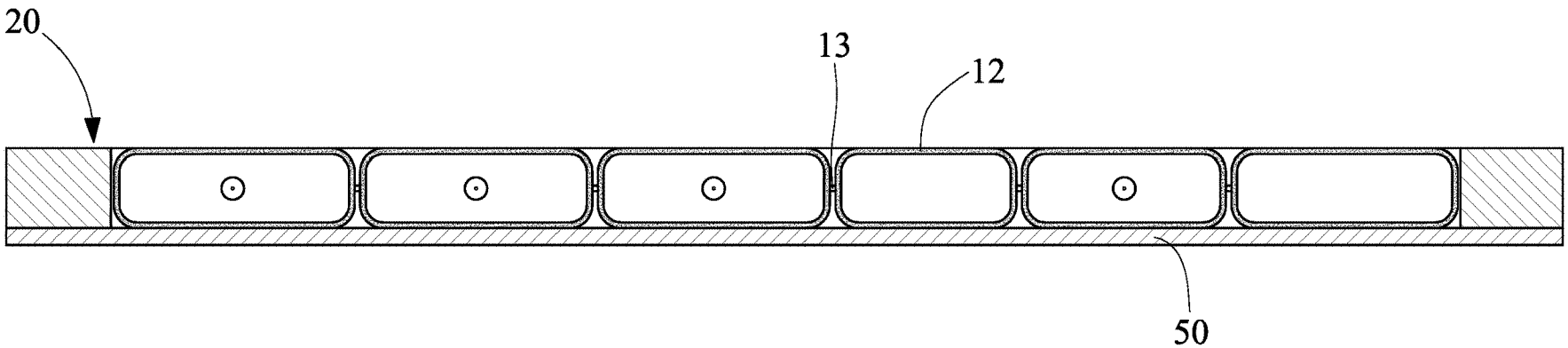
FIG. 5 is a cross-sectional view of the stress-reducing insole taken along a line V-V shown in FIG. 2.

Referring to FIGS. 1 through 5, a stress-reducing insole includes a cushion unit 10, a frame and a superficial layer 50 according to a first embodiment of the present invention. Preferably, the frame consists of two semi-frames 20 and 30.

The cushion unit 10 includes air bags 12 independent of one another. The air bags 12 are connected to one another by connectors 13. Each of the air bags 12 includes a valve 14. The valves 14 are configured corresponding to a ball needle 15 that is often used with an air pump to pump a ball for example.

The semi-frame 20 is made of an elastic, flexible and soft material suitable for insoles. The semi-frame 20 includes an internal face 22 shaped in compliance with a semi-periphery of the cushion unit 10. Bores 24 are made in the internal face 22 of the semi-frame 20. The semi-frame 20 includes two connective portions 23 at two ends.

The semi-frame 30 is made of an elastic, flexible and soft material suitable for insoles. The semi-frame 30 includes an internal face 32 shaped in compliance with another semi-periphery of the cushion unit 10. Bores 35 are made in the internal face 32 of the semi-frame 30. The semi-frame 30 includes two connective portions 34 at two ends.

The connective portions 23 of the semi-frame 20 are connected to the connective portions 34 of the semi-frame 30 so that the semi-frames 20 and 30 are joined to provide the frame around the cushion unit 10. The connective portions 23 of the semi-frame 20 are overlapped with the connective portions 34 of the semi-frame 30. The bores 24 and 35 receive the valves 14.

The superficial layer 50 is made of an elastic, flexible and soft material suitable for insoles. The superficial layer 50 is coated on the cushion unit 10 and the semi-frames 20 and 30. The superficial layer 50 is attached to the cushion unit 10 and the semi-frames 20 and 30 by adhesive for example.

Figure 6:
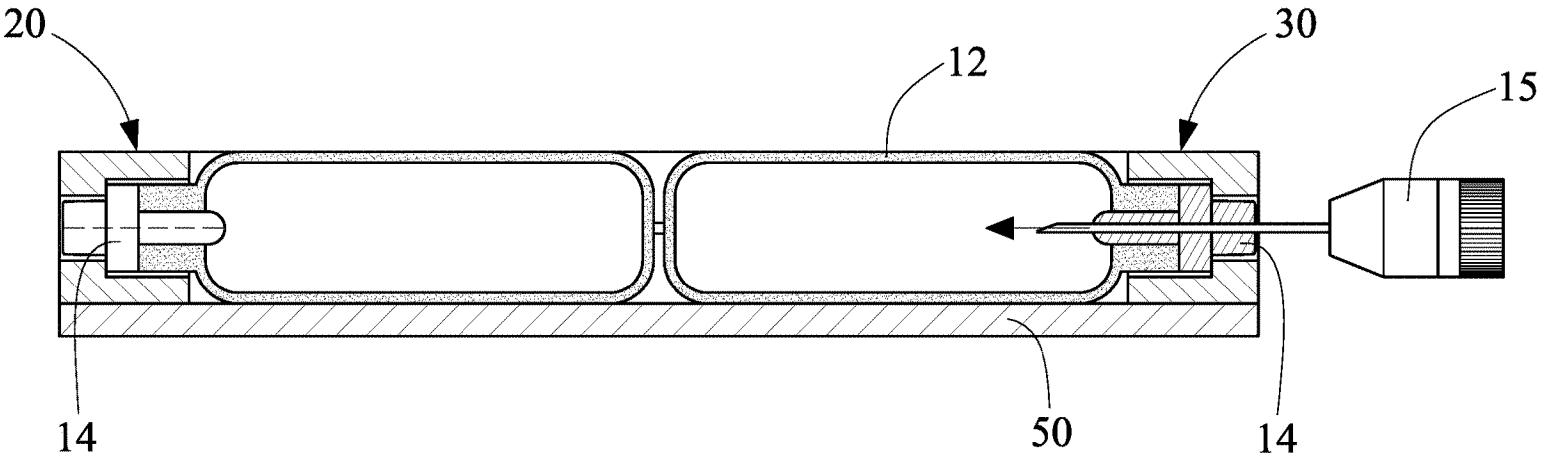
FIG. 6 is a cross-sectional view of the stress-reducing insole shown in FIG. 4 while inflated.

Referring to FIG. 6, the ball needle 15 is inserted in a selected one of the air bags 12 via the corresponding valve 14. Air is pumped into the selected air bag 12 via the ball needle 15.

Figure 7:
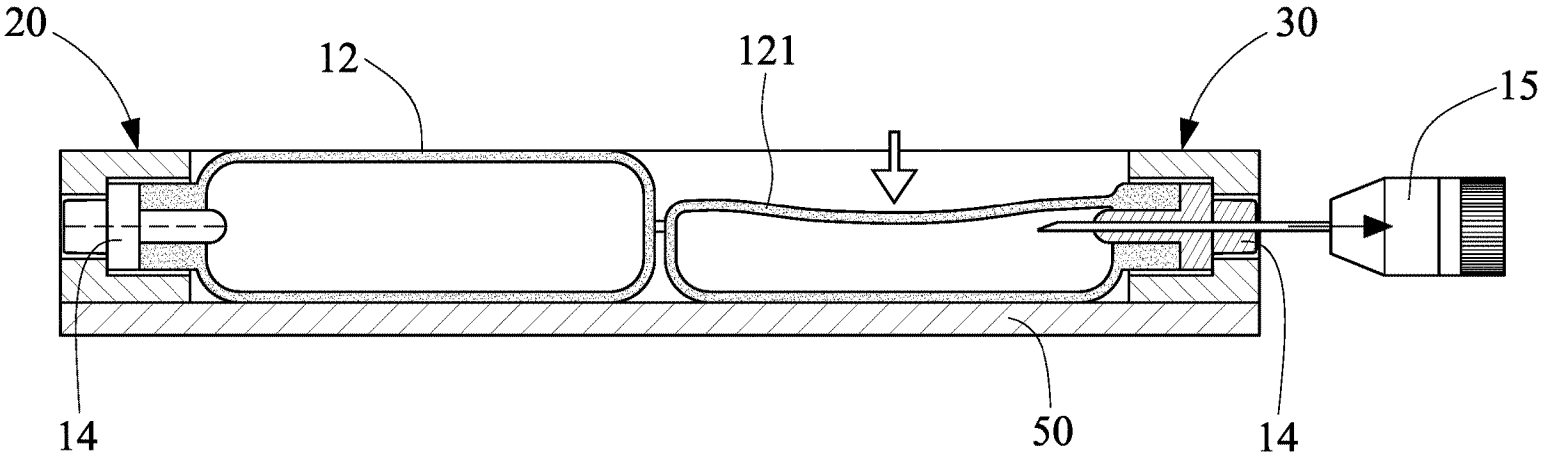
FIG. 7 is a cross-sectional view of the stress-reducing insole shown in FIG. 4 while deflated.

Referring to FIG. 7, the ball needle 15 is inserted in a selected one of the air bags 12 via the corresponding valve 14. Air is released from the selected air bag 12 via the ball needle 15.

Figure 8:
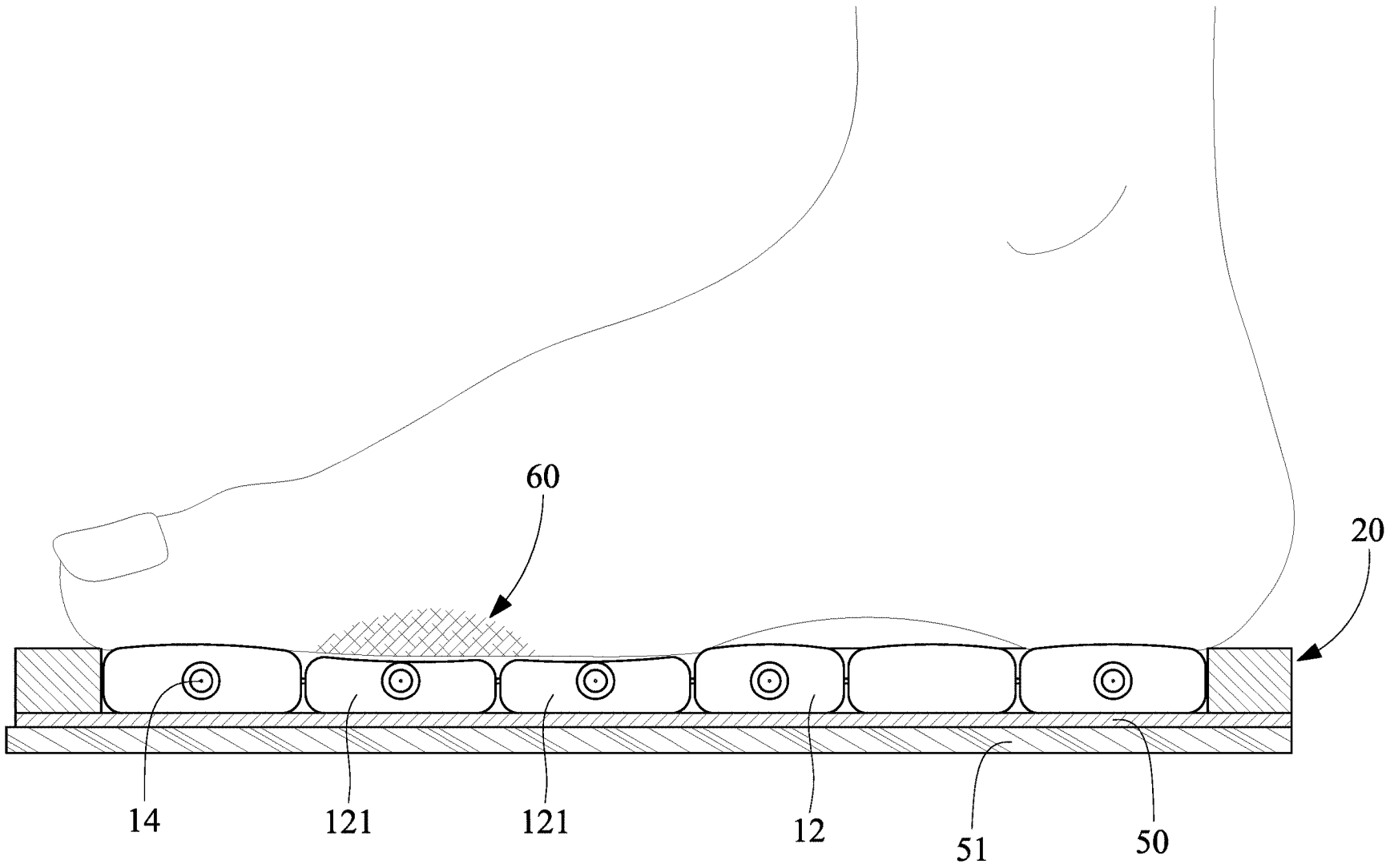
FIG. 8 is a cross-sectional view of the stress-reducing insole shown in FIG. 5 while supporting a user's foot.
Figure 9:
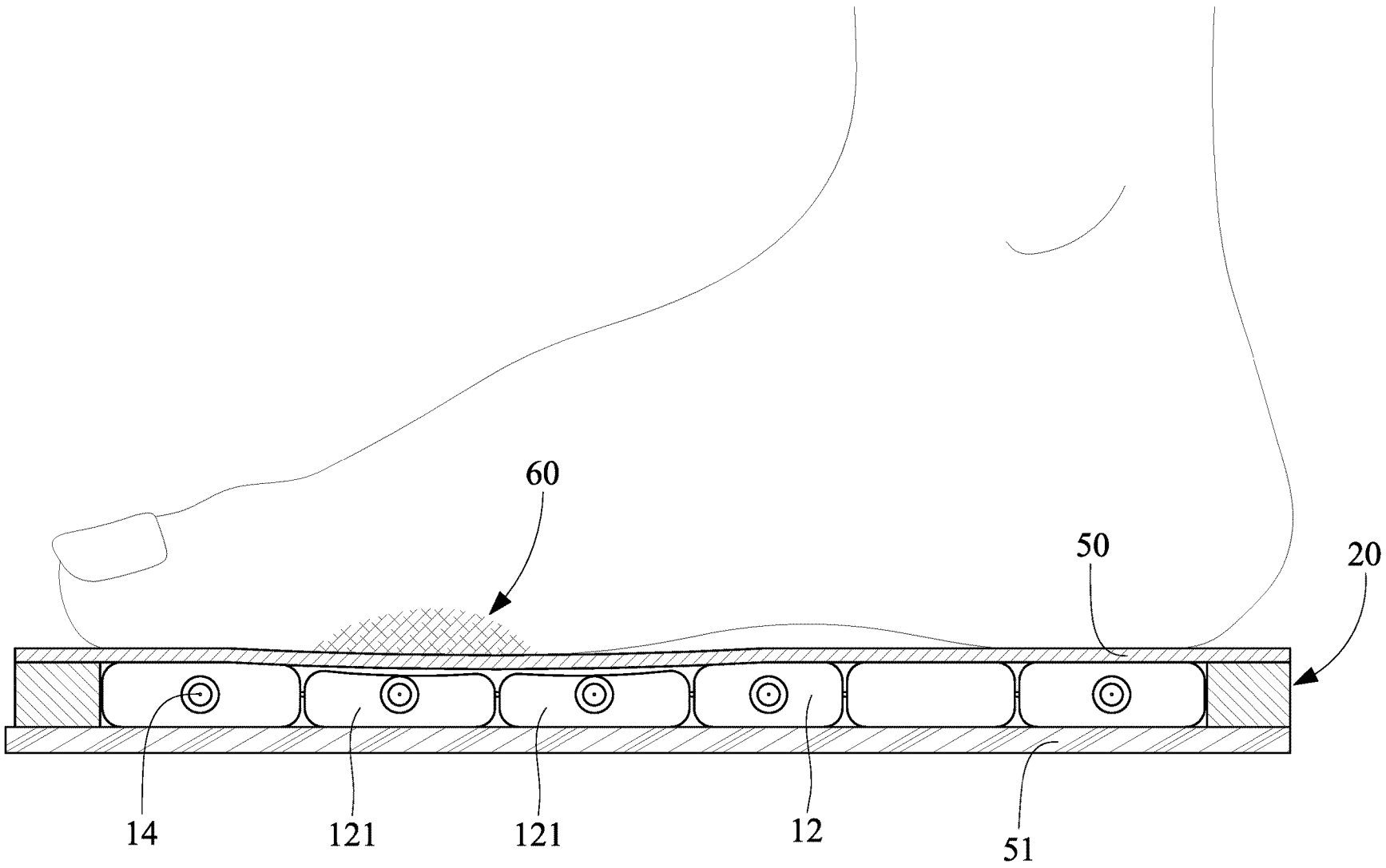
FIG. 9 is a cross-sectional view of the stress-reducing insole and the foot in another shown in FIG. 1.

Referring to FIGS. 8 and 9, some of the air bags 12 aligned to the painful areas 60 of a user's sole are deflated. Thus, stress in the painful areas 60 of a sole is reduced.

Referring to FIG. 8, the superficial layer 50 is used as a lower layer in contact with an outsole 51. Thus, the user's sole is in direct contact with the cushion unit 10. The inflated air bags 12 support the user's sole while the deflated air bags 121 are kept from the painful areas 60 of the user's sole, thereby reducing the stress in the painful areas 60 of the user's sole.

Referring to FIG. 9, the superficial layer 50 is used as an upper layer. The user's sole is in contact with the superficial layer 50. The inflated air bags 12 support the user's sole while the deflated air bags 121 are kept from the painful areas 60 of the user's sole, thereby reducing the stress in the painful areas 60 of the user's sole.

How much each of the air bags 12 is inflated or not at all is determined by how much the stress in a corresponding one of the painful areas 60 of the user's sole must be reduced and how much support the user's sole needs.

Figure 10:
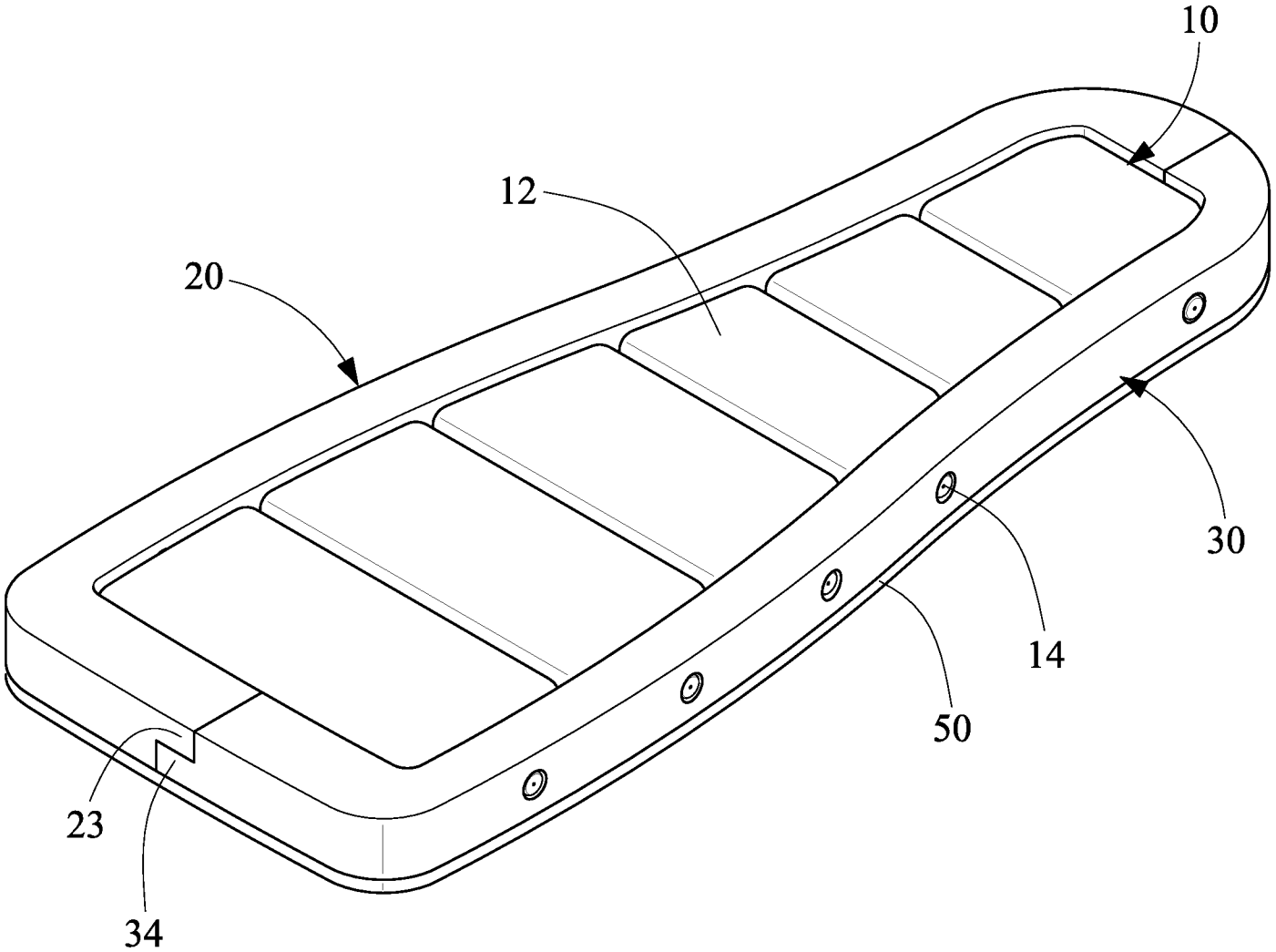
FIG. 10 is a perspective view of a stress-reducing insole according to the second embodiment of the present invention.

Referring to FIG. 10, there is shown a stress-reducing insole according to a second embodiment of the present invention. The second embodiment is identical to the first embodiment except for that the cushion unit 10 includes air bags 12 in different shapes in a different arrangement.

Figure 11:
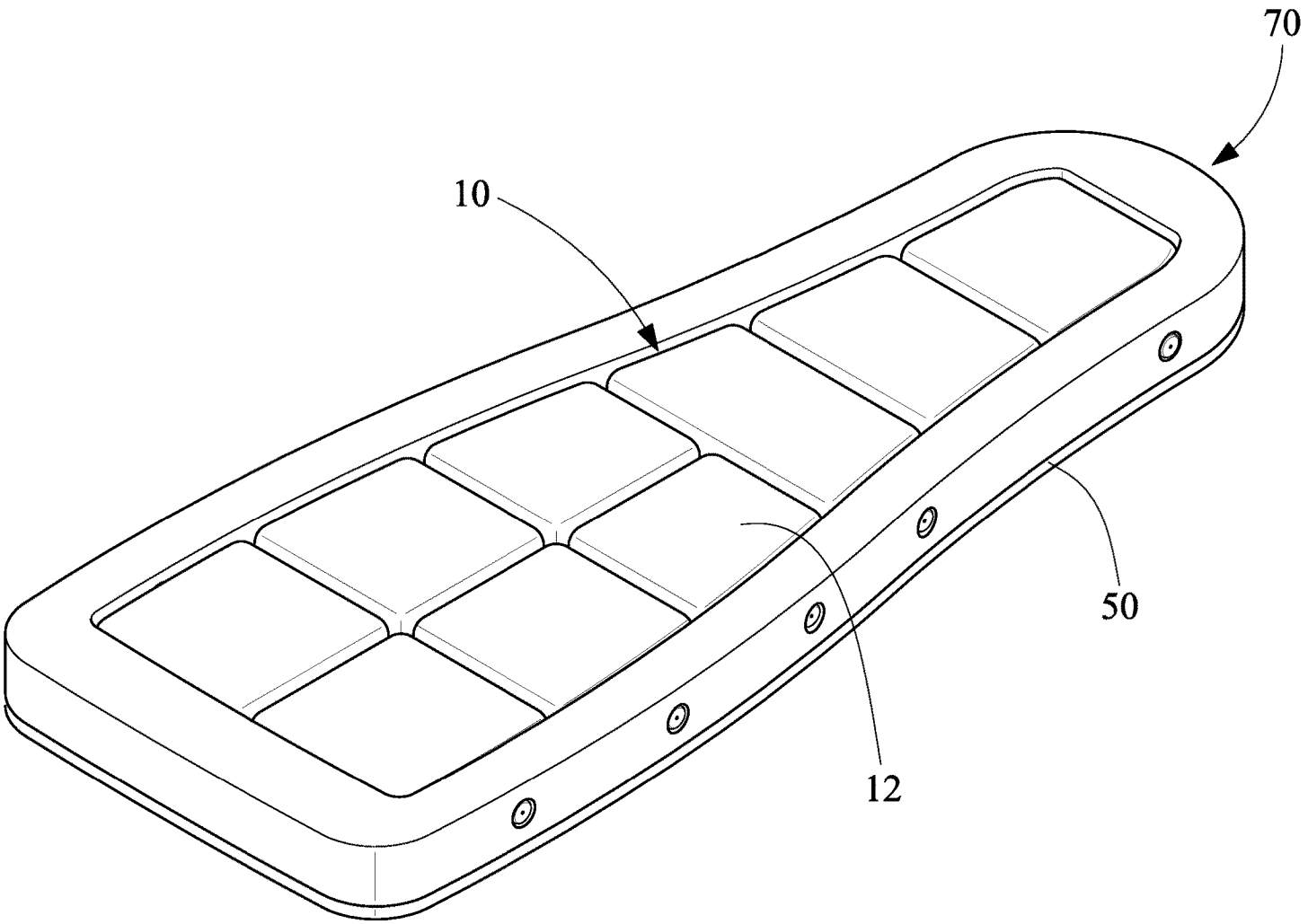
FIG. 11 is a perspective view of a stress-reducing insole according to the third embodiment of the present invention.
Figure 12:
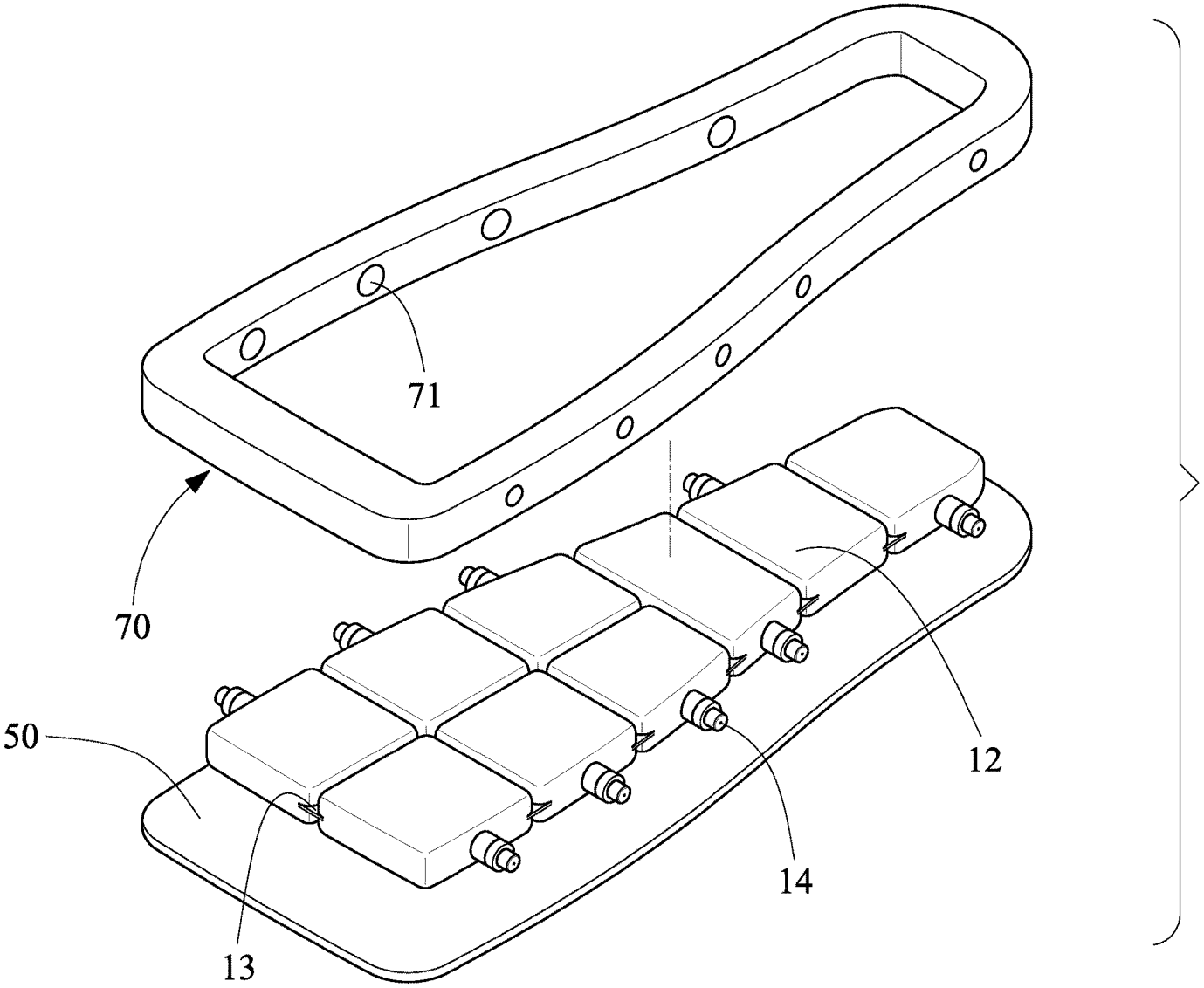
FIG. 12 is an exploded view of the stress-reducing insole depicted in FIG. 11.

Referring to FIGS. 11 and 12, there is shown a stress-reducing insole according to a third embodiment of the present invention. The third embodiment is identical to the first embodiment except for including a continuous frame 70 instead of the frame that consists of the semi-frames 20 and 30. The frame 70 includes bores 71 for receiving the valves 14.

The present invention has been described via illustration of the embodiments. Those skilled in the art can derive variations from the embodiments without departing from the scope of the present invention. Therefore, the embodiments shall not limit the scope of the present invention defined in the claims.

The invention claimed is:

1. A stress-reducing insole comprising:

a cushion unit (10) having an outer perimeter, the cushion unit comprising air bags (12), wherein each of the air bags (12) comprises a valve (14) via which air is pumped into or released from the corresponding one of the air bags (12);

a frame extending around the outer perimeter of the cushion unit (10) such that the cushion unit substantially fills an area encompassed by the frame and comprising two semi-frames (20, 30), wherein each of the semi-frames (20, 30) comprises bores (24, 35) for receiving the valves (14); and a superficial layer (50) coated on the frame.

2. A stress-reducing insole comprising:

a cushion unit (10) comprising independent air bags (12) and connectors (13) for connecting the air bags (12) to one another, wherein each of the air bags (12) comprises a valve (14) via which air is pumped into or released from the corresponding one of the air bags (12); and two semi-frames (20, 30) each of which comprises:

an internal face (22, 32) shaped in compliance with a semiperiphery of the cushion unit (10); bores (24, 35) for receiving the valves (14); and two connective portions (23, 34) formed at two ends, wherein the connective portions (23) of one of the semi-frames (20) are connected to the connective portions (34) of the remaining one of the semi-frames (30) so that the semi-frames (20, 30) are joined to provide a frame around the cushion unit (10).

3. The stress-reducing insole according to claim 2, further comprising a superficial layer (50) for covering one of two opposite faces of the frame.

4. The stress-reducing insole according to claim 2, wherein the connective portions (23) of one of the semi-frames (20) are overlapped with the connective portions (34) of the remaining one of the semi-frames (30).

5. A stress-reducing insole comprising:

a cushion unit (10) having an outer perimeter, the cushion unit comprising independent air bags (12) connected to one another, wherein each of the air bags (12) comprises a valve (14) via which air is pumped into or released from the corresponding one of the air bags (12);

a frame (70) extending around the outer perimeter of the cushion unit (10) such that the cushion unit substantially fills an area encompassed by the frame and comprising bores (71) for receiving the valves (14); and a superficial layer (50) for covering one of two opposite faces of the cushion unit (10).

* * * * *